US005103883A

United States Patent [19]

Viikari et al.

[11] Patent Number: 5,103,883

[45] Date of Patent: Apr. 14, 1992

[54] METHOD FOR THE DEBARKING OF LOGS

[75] Inventors: Liisa Viikari, Helsinki; Marjaana Ratto, Vantaa; Anne Kantelinen, Espoo, all of Finland

[73] Assignee: Kone Oy, Helsinki, Finland

[21] Appl. No.: 639,668

[22] Filed: Dec. 24, 1990

[30] Foreign Application Priority Data

Dec. 27, 1989 [FI] Finland ..... 896291

[51] Int. Cl.[5] ..... B27L 1/00

[52] U.S. Cl. ..... 144/342; 144/209 R; 144/380

[58] Field of Search ..... 144/208 R, 209 D, 380, 144/340, 341, 342

[56] References Cited

U.S. PATENT DOCUMENTS 2,995,164 8/1961 Bott ..... 144/342

FOREIGN PATENT DOCUMENTS 0262040 3/1988 European Pat. Off. .

63-42988 2/1988 Japan .

*Primary Examiner*—W. Donald Bray

*Attorney, Agent, or Firm*—Birch, Stewart, Kolasch & Birch

[57] ABSTRACT

A method for the debarking of logs is disclosed, which comprises treating the logs with enzymes to weaken the bonds between the bark and wood. An apparatus is also disclosed for the debarking of logs, comprising a conveyor for conveying the logs to a debarker, a piping system with nozzles for spraying the logs with an enzyme solution, a device for separating the enzyme solution from the logs and conducting it back into the piping system, and a feed device for supplying enzyme solution into the circulation system.

25 Claims, 4 Drawing Sheets

METHOD FOR THE DEBARKING OF LOGS

BACKGROUND OF THE INVENTION

1. Field of the Invention

This invention relates to a method for the debarking of logs.

2. Description of the Related Art

In the production of chemical and/or groundwood pulp from logs, the fibre yield from the bark of the logs is often small and of low quality. In addition, the presence of the bark in the pulp causes problems relating to the use of extractives and an increased consumption of chemicals. Accordingly, the logs are usually debarked prior to defibration. The need for debarking depends primarily upon the intended product, but also on the equipment and process used for defibration. For instance, the process used for the production of bleached softwood sulphate tolerates the presence of small quantities of bark, whereas the production of groundwood pulp generally requires complete debarking of the logs.

Presently, drum debarkers are typically used for the debarking of pulpwood. However, other debarking methods include the use of cambio debarkers, rotor debarkers of high-pressure water jets.

Trees have a cambium layer between the bark and the wood. It is the cambium layer that is the living and continuously growing part of the tree. The cells in this layer divide continuously, which is why they tend to have a lower mechanical strength than cells elsewhere in the tree. In debarking, the aim is to remove the bark together with the cambium layer. Characteristically, the cambium comprises a high pectin content. Pectin polymers consist of galacturonic acid, ramnose, arabinose and galactose. As well, the cambium comprises hemicellulose, cellulose and protein.

A significant disadvantage of current mechanical debarking methods and equipment is that in order to achieve a desired degree of debarking it is necessary to continue the debarking process well beyond the time it takes to remove substantially all the bark, in order that pieces which hold steadfastly to the logs can be removed. This results in significant wood loss especially in the trunk areas already completely debarked. Moreover, it leads to increased debarking times and greater energy consumption.

SUMMARY OF THE INVENTION

It is an object of the present invention to eliminate inherent disadvantages of prior methods and to provide an improved method of removing bark from logs which is faster and more accurate than previously possible, in that the amount of wood fibres removed together with the bark is minimized.

A further object of the invention is to provide an apparatus for implementing the improved method.

Accordingly, the invention provides a method for the debarking of logs, comprising the treatment of the logs with an enzyme solution in order to weaken the bonds between the bark and wood, followed by debarking of the logs in a conventional manner.

The invention further provides an apparatus for the debarking of logs, comprising a conveyor for conveying the logs to a debarker; a piping system for carrying an enzyme solution; nozzles for spraying the logs with the solution; a device for separating the enzyme solution from the logs and conducting it back into the piping system; and a feed device for supplying fresh enzyme solution into the circulation system.

The invention is based on the principle that in order to weaken the bonds between the wood and the bark it is necessary to treat the logs with enzymes during the debarking process. The weakening of the bonds is implemented using enzymes which break down polymers present in the cells of the cambium layer and/or which weaken the bonds between the cells.

Hitherto, enzymes have been used in the treatment of woodpulp or chemical pulp, e.g. for detaching the fibers in the pulping of bark fiber (Improved enzymatic pulping of bark fiber, JP 63042988) or for the drainage of pulp (Treatment of paper pulp with hemicellulase, EP 262040). However, enzymes have not been used for the weakening of bonds between the wood and bark.

In the method of invention, it is possible for use, for instance, pectin breaking enzymes, hemicellulases, cellulases and/or proteases, and other enzymes capable of weakening the bonds between wood and bark and/or breaking down polymers present in the cambium.

The enzymes are used in concentrations varying with the enzymatic activity of the preparation used. The enzyme concentration is not a critical factor because the effect of enzyme treatment depends, in addition to the enzyme concentration, on the treatment time as well as other conditions. Thus, the desired effect can be achieved, for example, by using a lower enzyme concentration and a longer treatment time or a higher enzyme concentration and a shorter treatment time. The solution used for the treatment may contain, for instance, polygalacturonase activity, which may vary between from 5,000 to 5,000,000, suitably between from 24,000 to 1,200,000 and preferably between from 180,000 to 600,000 nkat enzyme/1 of solution.

Alternatively, the solution used for the treatment may contain pectin lyase activity, which may vary between from 20 to 20,000, suitably between from 80 to 4,000, and preferably between from 600 to 2,000 nkat of the enzyme/1 solution.

The solution used for the treatment may instead contain xylanase activity of from 50 to 60,000, suitably from 260 to 13,000, and preferably from 2,000 to 7,000 nkat of the enzyme/1 of solution.

Moreover, the solution used for the treatment may contain endoglucanase activity of from 150 to 200,000, suitably from 700 to 36,000, and preferably from 5,400 to 18,000 nkat of the enzyme/1 of solution.

For the weakening of the bonds between wood and bark, the activities polygalacturonase and pectin lyase are particularly effective. Especially advantageous is a treatment solution that comprises, in addition to the above-mentioned activities, xylanase or endoglucanase activity or both.

The pH of the treatment solution should be such that the enzymes in question are able to weaken the bonds between the wood and bark, to break down polymers present in the cambium and/or to weaken the bonds between the cells of the cambium. An appropriate pH is, for example, from 2 to 8, suitably from 3 to 7, and preferably about 5. If necessary, the treatment solution can be buffered to a desired pH level, using, for example, sodium citrate or any other buffering substance known in enzyme technology.

The treatment time is from 1 hour to 3 days, preferably from 1 to 24 hours or longer, more preferably from 2 to 6 hours.

The treatment temperature, i.e. the temperature of the treatment solution, is for example, from 5° to 80° C., suitably from 10° to 65° C., and preferably from about 20° to 40° C.

According to the invention, enzymes are used to assist mechanical debarking. The logs may be subjected to enzyme treatment prior to debarking by known methods. If desirable, the enzyme treatment may also be effected after debarking, i.e. part of the bark is first removed, possibly after enzyme treatment, whereupon the logs are subjected to an enzyme treatment designed to weaken the bonds between the wood the remaining portions of the bark. This allows the remaining bark portions to be removed during a second debarking procedure which may consist of mechanical or some other kind of treatment. The enzyme treatment may also be implemented in other ways in conjunction with the debarking.

The enzyme treatment may be implemented by immersing the logs in the treatment solution, or by flushing and/or spraying the logs with the treatment solution.

The enzyme treatment of the invention has the effect of reducing the detaching resistance of the bark, i.e. it tends to make the bark loosen. This facilitates mechanical debarking and significantly increases the speed thereof. The fact that the bark is more easily removed reduces the amount of energy needed for the debarking. A higher and more constant degree of debarking is achieved. Moreover, enzyme treatment helps reduce wood losses that occurs in traditional mechanical debarking as a result of differences in the barking resistance between different trunks or logs.

The apparatus of the invention for the debarking of logs comprises: a conventional conveyor for conveying the logs to a debarking machine, such as, for example, a barking drum, a high-pressure water debarker, etc., and, arranged, for instance, in conjunction with the conveyor; and a piping system with nozzles for spraying the logs with an enzyme solution. The apparatus also preferably comprises a device for separating the enzyme solution from the logs and conducting it back into the piping system which carries the enzyme solution, allowing the solution to be reused. The apparatus also comprises feed connections for supplying fresh water and enzyme solution, for example, into the piping. Naturally, the piping system is provided with a circulation pump for creating a sufficient pressure.

BRIEF DESCRIPTION OF THE DRAWINGS

Embodiments of the invention will now be described, by way of example, with reference to the accompanying drawings, in which.

DESCRIPTION OF PREFERRED EMBODIMENTS

Figure 1:
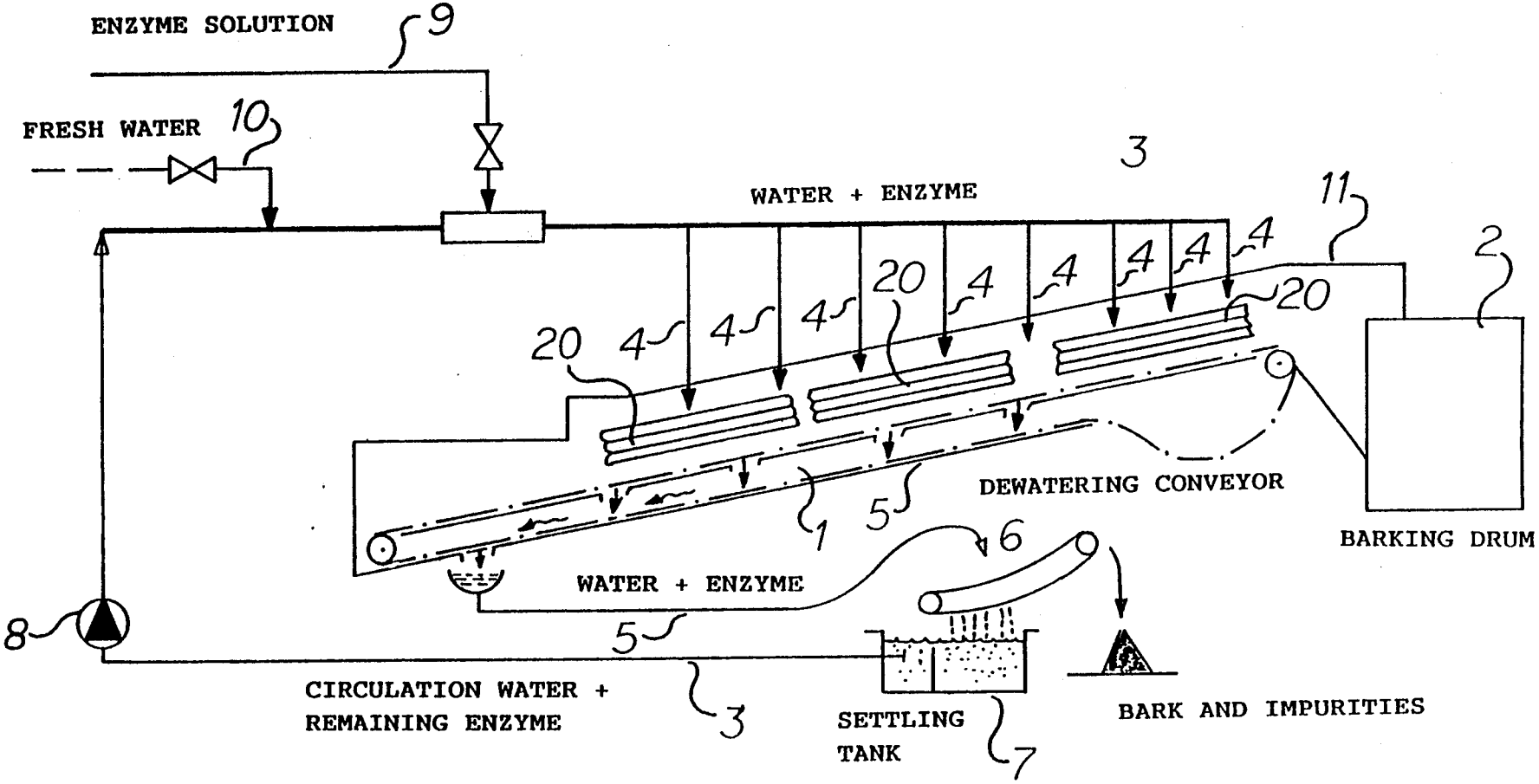
FIG. 1 is a schematic illustration of a preferred embodiment of the method and apparatus according to the invention.

Referring now to FIG. 1, the procedure of the invention is illustrated as applied in conjunction with the conveyor 1 of an ordinary barking drum 2. The logs are placed in bundles 20 on a chain conveyor 1 which conveys them slowly into the drum 2. Arranged in concert with the conveyor is a system of pipes 3 carrying an enzyme solution. The pipes are provided with nozzles 4 for spraying the logs with the enzyme solution. The enzyme treatment takes place while the logs are slowly moving on the conveyor 1 towards the barking drum. The equipment comprises a means 5 for separating and recovering the used enzyme solution. Furthermore, the solution is conducted to a de-watering conveyor 6 for separating the bark and other impurities from the enzyme solution. The solution is collected in a settling tank 7, from where it is passed back into the circulation system 3. The circulation system is provided with a pump 8 and a feed connection 9 for the fresh enzyme solution and a feed connection 10 for a fresh water supply. In short, the logs 20 to be debarked are sprayed with an enzyme solution, the solution is recovered whereafter bark and other impurities are removed therefrom, the solution is allowed to settle and is then sprayed again onto the logs. Fresh water and fresh enzyme solution are added into the circulation system as appropriate.

In the embodiment illustrated in FIG. 1, the nozzles 4 for enzyme solution are placed within a cover 11 provided for the conveyor 1. The cover 11 effectively forms a log treatment chamber. In the cold season, this chamber can be used for thawing and warming icy logs by spraying them with warm water through the nozzles.

As a result of enzyme treatment, the bonds between the bark and wood are weakened and the bark is more easily removed from the logs in the barking drum. Accordingly, the time needed for drum debarking is significantly shortened. Moreover, the capacity of the plant increases and, due to the shorter debarking time, the wood losses occurring in the drum are reduced.

Figure 2:
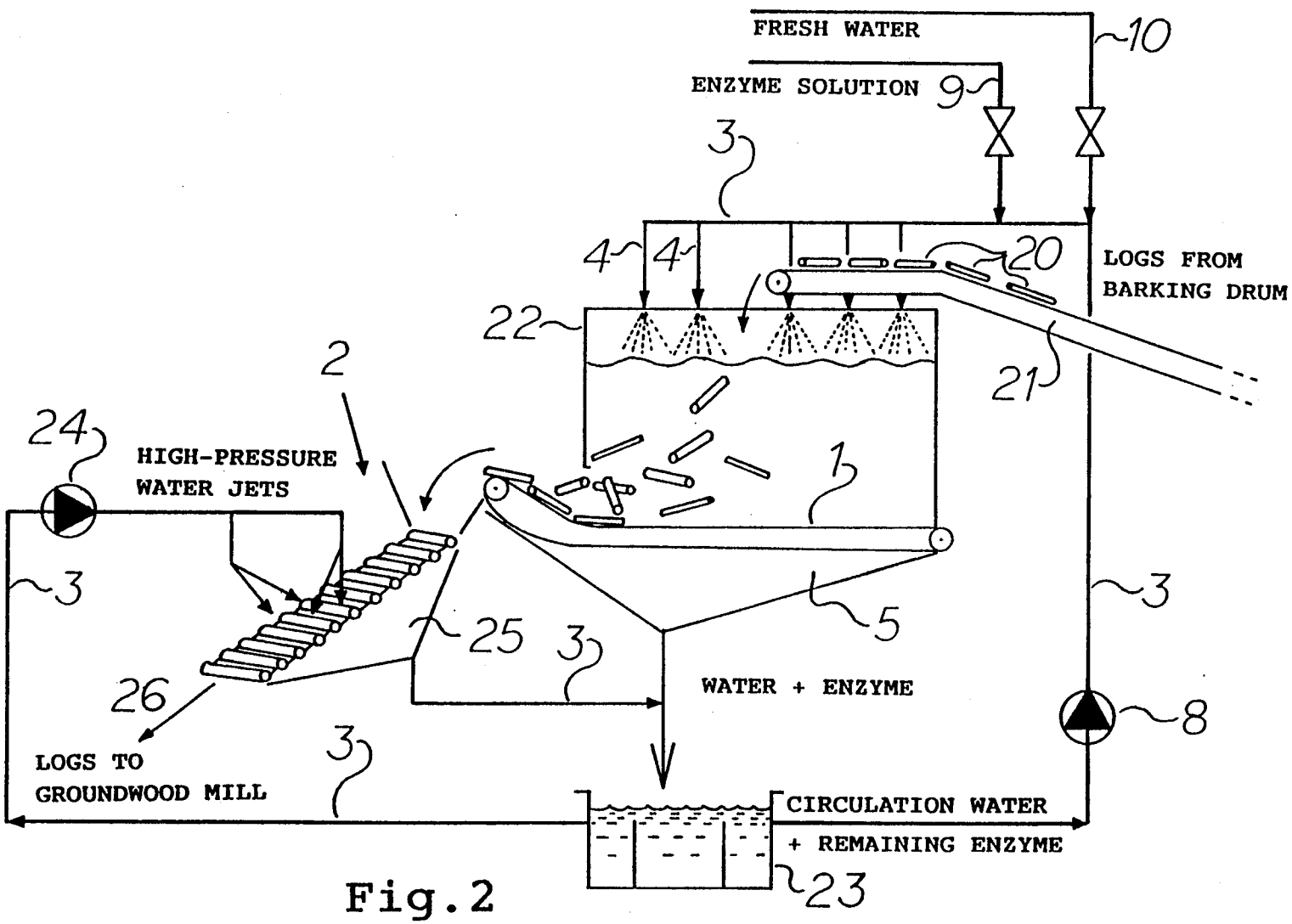
FIG. 2 is a schematic illustration of an alternative embodiment of the method and apparatus according to the invention.

FIG. 2 illustrates an alternative embodiment of the procedure and apparatus of the invention, in which prebarked logs 20 are conveyed by a conveyor 21 into an intermediate storage chamber, i.e. an enzyme treatment chamber 22. The chamber is connected to a piping system 3 circulating an enzyme solution and is provided with nozzles 4. Provided on the floor of the chamber is a scraper conveyor 1 which slowly conveys the prebarked logs from the chamber to a high-pressure water debarker 2. The enzyme treatment takes place in the treatment chamber 22 where the logs are sprayed with an enzyme solution from the circulation pipe system 3. The circulation pipe system is continuously supplied with fresh enzyme solution via feed connection 9 and with fresh water via feed connection 10. The system is provided with a pump 8 which pumps the solution into the nozzles 4. The conveyor 1, for example a scraper conveyor, is provided with a drainage means 5 for separating the water from the logs and passing it, for instance, into a settling tank 23 for reuse. The water in the settling tank 23 is also used to feed the high-pressure water debarker 2 via a high-pressure pump 24. The high-pressure water debarker is also provided with a drainage means 25 for separating the water and returning it into the settling tank 23.

When the apparatus as depicted in FIG. 2 is used, the pre-barked logs obtained from the debarker (e.g. a barking drum) are conveyed into the treatment chamber 22, treated with an enzyme solution and conveyed further into a high-pressure water debarker 2, which effects the final debarking. The logs are then taken, for instance, to a groundwood plant.

The following examples further illustrate the invention.

EXAMPLE 1

Unbarked birch logs were treated with a pectinase solution. After two days of treatment, the enzyme treated samples were compared with samples similarly soaked in water to see if the bark had loosened. It was found that the bark of the enzyme treated samples had partially come off during the treatment and that the remaining bark could be easily detached by tearing it off manually, whereas the bark on the water soaked samples remained tightly attached to the wood.

EXAMPLE 2

Figure 3:
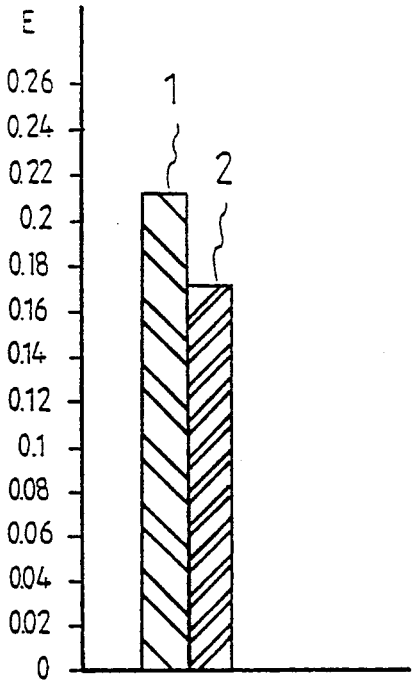
FIG. 3 is a plot comparing the relative energy E required to detach bark from treated and untreated log samples.

Unbarked fir logs were treated with a pectinase preparation having a polygalacturonase activity of 180,000 nkat/ml. The amount of enzyme preparation used as 1 ml/l of treatment solution. The treatment solution had a pH value of about 5 and its temperature was 20° C. After 24 hours of treatment, the energy required for removing the bark was measured using a device in which, by applying a shear force, a fixed blade detaches a piece of bark from the surface of a slowly rotating disc of wood. The shear stress applied to the bark was measured using a force sensor and registered by means of a recorder. From the time integral of the shear force, the energy required for detaching the piece of bark was calculated as from the beginning of the application of force to the moment of detachment of the bark. As a reference value, a corresponding relative E value was determined for untreated log samples. The results are shown in FIG. 3, in which column diagram 1 represents the relative energy E required for detaching the bark from an untreated log sample and column diagram 2 represents the relative energy E in the case of an enzyme treated log sample. In this experiment, the enzyme treatment reduced the required energy by approximately 23%.

EXAMPLE 3

Unbarked fir logs were treated with a pectinase preparation having a polygalacturonase activity of 120,000 nkat/ml, a pectin lyase activity of 400 nkat/ml, a xylanase activity of 1,300 nkat/ml and an endoglucanase activity of 3,600 nkat/ml. The treatment was implemented by immersing the logs in 10 mM sodium citrate buffered treatment solutions having a pH of 5, into which had been added 0, 0.3, 1.5 and 7.5 ml per litre, respectively, of said pectinase preparation. The samples were treated for 24 hours at a temperature of 20° C. The energy required for removing the bark was measured as in example 2.

Figure 4:
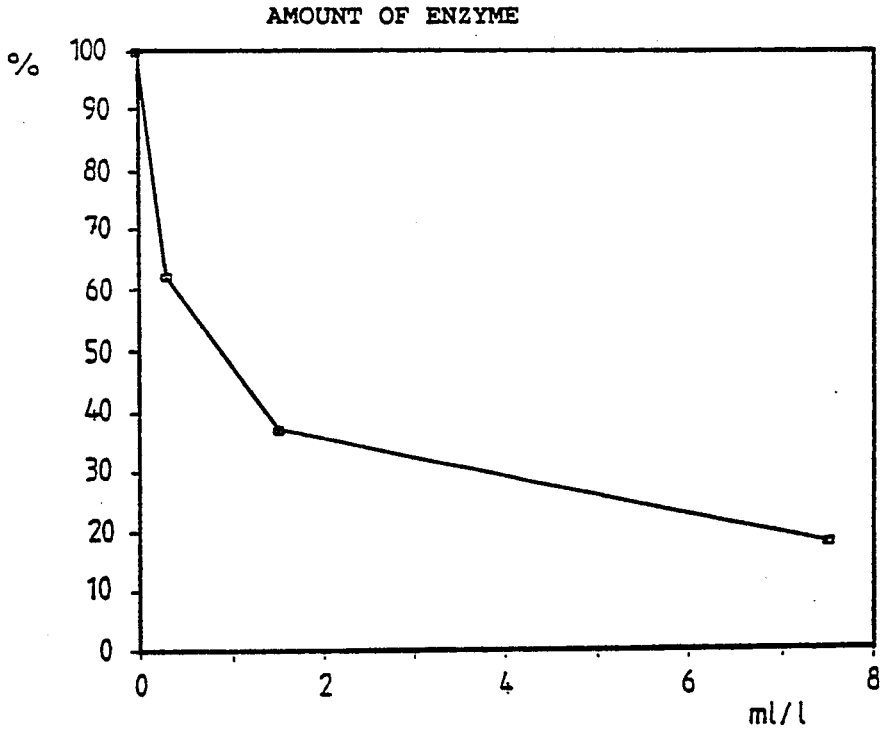
FIG. 4 is a plot of relative energy (%) as a function of enzyme content (ml/l)

The measurement results obtained in the experiment are presented in FIG. 4, which depicts the relative energy (%) as a function of enzyme content (ml/l). When the amount of enzyme preparation used was 0.3 ml/l of treatment solution, the energy required for detaching the bark was 38% lower than the corresponding energy required without enzyme treatment. When the amount of enzyme preparation used was 7.5 ml/l of treatment solution, the energy required was 80% lower than the energy required without enzyme treatment.

EXAMPLE 4

Logs were treated with a pectinase preparation as specified in the previous example. The logs were immersed in a mM sodium citrate buffer with pH 5 and a pectinase preparation content of 1.5 ml/l. The length of treatment was 24 hours and it was effected at temperatures of both 20° C. and 40° C. Preference experiments were performed in the same circumstances without the use of enzymes. After the treatment, the relative energy (E) required for removing the bark was measured as in example 2.

Figure 5:
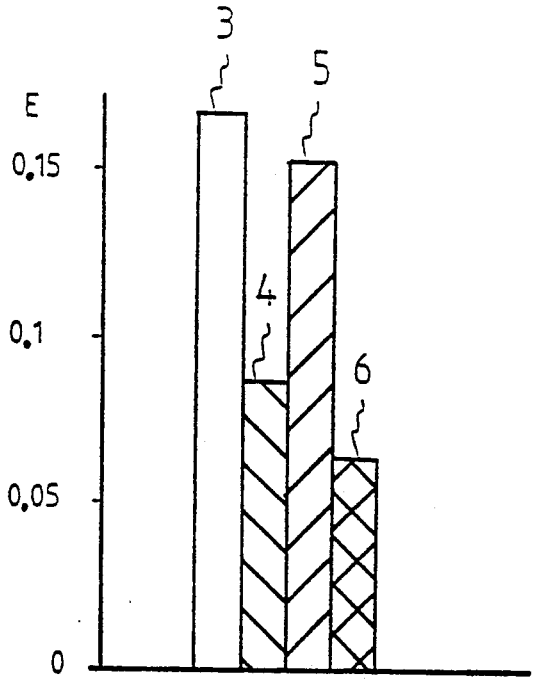
FIG. 5 is a plot comparing the relative energy E required to detach bark of various treated and untreated log samples.

The measurement results are shown in FIG. 5, in which diagram 3 represents the relative debarking energy without enzyme treatment, at 20° C.; diagram 4, enzyme treatment at 20° C.; diagram 5, treatment without enzyme at 40° C.; and diagram 6, enzyme treatment at 40° C. Clearly raising the temperature of treatment enhances the effect of the treatment both with and without the use of enzymes. However, in the case of treatment with enzymes, the effect of increasing the temperature is even more profound.

EXAMPLE 5

Unbarked fir logs were treated with an enzyme preparation as described in example 3. The treatment was performed by immersing the logs in a water solution having 1.5 ml/l of said pectinase preparation. The treatment temperature was 20° C. and the energy required for removing the bark was measured after 2, 12 and 24 hours as described in example 2. The reference sample was a fir log treated in the same conditions for 24 hours without enzyme.

Figure 6:
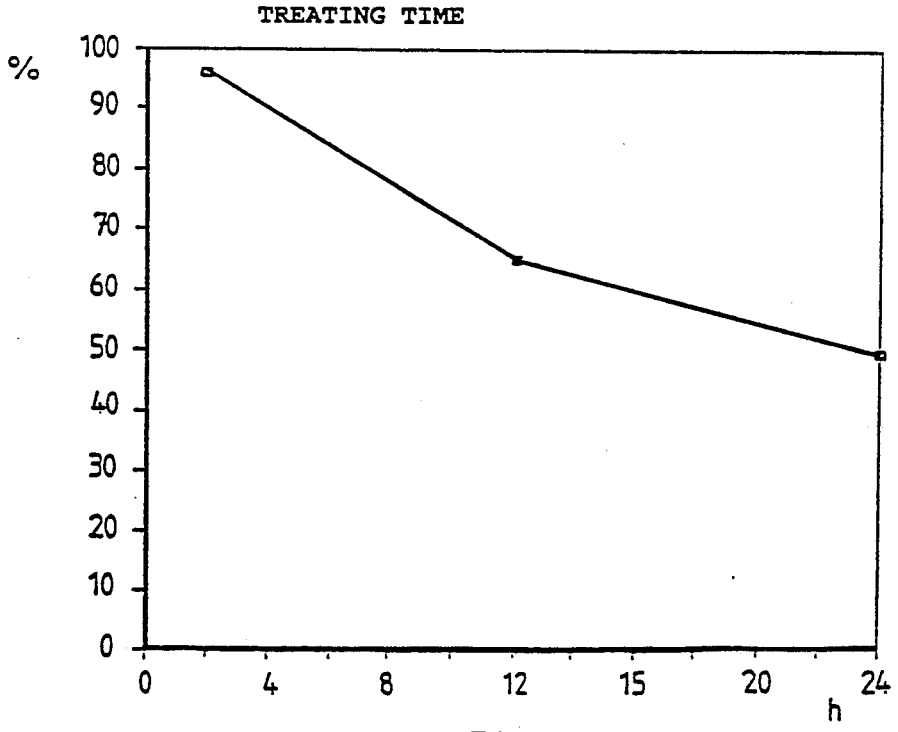
FIG. 6 is a graph plotting relative energy (%) versus the time of enzyme treatment in hours.

The measurement results are presented in FIG. 6. Two hours of enzyme treatment reduced the required debarking energy by about 5% as compared to soaking without enzymes. After 12 hours of enzyme treatment, the debarking energy was reduced by approx. 35%, and after 24 hours by approximately 50%. Clearly, increasing the treatment time enhances the effect of the enzyme.

It will be obvious to those skilled in the art that embodiments of the invention are not restricted to the examples described above, but may instead be varied within the scope of the following claims.

We claim:

1. A method for the debarking of logs comprising the treatment of the logs with an enzyme solution in order to weaken the bonds between the bark and wood, followed by mechanical debarking of the logs.

2. A method as claimed in claim 1, wherein the enzyme solution used breaks down the polymers present in the cambium layer of trees and wherein the enzymes used are selected from the group consisting of pectinase, hemicellulase, cellulase, protease or a mixture of any combination thereof.

3. A method as claimed in claim 1, wherein the enzyme solution used for the treatment has polygalacturonase activity of from 5,000 to 5,000,000 nkat/l of solution; pectin lyase activity of from 20 to 20,000 nkat/l of solution; xylanase activity of from 50 to 60,000 nkat/l of solution; endoglucanase activity of from 150 to 200,000 nkat/l of solution; or any combination thereof.

4. A method as claimed in claim 1, wherein the enzyme solution used for the treatment has polygalacturonase activity of from 24,000 to 1,200,000 nkat/l of solution; pectin lyase activity of from 80 to 4,000 nkat/l of solution; xylanase activity of from 260 to 13,000 nkat/l of solution; endoglucanase activity of from 700 to 36,000 nkat/l of solution; or any combination thereof.

5. A method as claimed in claim 1, wherein the enzyme solution used for the treatment has polygalacturonase activity of from 180,000 to 600,000 nkat/l of solution; pectin lyase activity of from 600 to 2,000 nkat/l of solution; xylanase activity of from 2,000 to 7,000 nkat/l of solution; endoglucanase activity of from 5,400 to 18,000 nkat/l of solution; or any combination thereof.

6. A method as claimed in claim 1, wherein the enzyme solution has a pH of from 2 to 8.

7. A method as claimed in claim 1, wherein the enzyme solution has a pH of from 3 to 7.

8. A method as claimed in claim 1, wherein the enzyme solution has a pH of about 5.

9. A method as claimed in claim 1, wherein the enzyme solution is buffered to a pH of from 3 to 7.

10. A method as claimed in claim 1, wherein the enzyme solution is buffered to a pH of about 5.

11. A method as claimed in claim 1, wherein the duration of enzyme treatment is from 1 hour to 3 days.

12. A method as claimed in claim 1, wherein the duration of enzyme treatment is from 1 to 24 hours.

13. A method as claimed in claim 1, wherein the duration of enzyme treatment is from 2 to 6 hours.

14. A method as claimed in claim 1, wherein the temperature of the enzyme solution is from 5° to 80° C.

15. A method as claimed in claim 1, wherein the temperature of the enzyme solution is from 10° to 65° C.

16. A method as claimed in claim 1, wherein the temperature of the enzyme solution is from 20° to 40° C.

17. A method as claimed in claim 1, wherein the enzyme treatment is effected by immersing the logs in the enzyme solution by flushing and/or spraying the logs with the enzyme solution.

18. A method as claimed in claim 1, wherein the logs are debarked mechanically both before and after the enzyme treatment.

19. A method as claimed in claim 1, wherein the logs are transported to a debarker and sprayed with an enzyme solution, thereafter the solution being recovered; the logs then being conveyed to a debarker for mechanical debarking and the recovered enzymes added to the enzyme solution for reuse.

20. A method as claimed in claim 19, wherein the logs are transported by means of a conveyor and the debarker is a barking drum.

21. A method as claimed in claim 1, wherein the logs are debarked mechanically and are then treated with enzyme solution by spraying and/or immersing, thereafter the enzyme solution being recovered; the logs then being debarked by use of a high-pressure water jet and the recovered enzymes added to the enzyme solution for reuse.

22. A method as claimed in claim 21, wherein the mechanical debarker is a barking drum.

23. An apparatus for the debarking of logs, comprising a conveyor for conveying the logs to a debarker; a piping system for carrying an enzyme solution; nozzles for spraying the logs with the solution; separating means for separating the enzyme solution from the logs and conducting it back into the piping system; and a feed device for supplying fresh enzyme solution into the circulation system.

24. The use of enzymes in the debarking of logs to weaken the bonds between the bark and wood, the enzymes being selected from the group consisting of pectinases, hemicellulases, cellulases and proteases.

25. An apparatus as claimed in claim 23, wherein said separating means comprises a drain.

* * * * *